US010769881B1

(12) United States Patent
Adams

(10) Patent No.: US 10,769,881 B1
(45) Date of Patent: Sep. 8, 2020

(54) AUGMENTED REALITY GAME SYSTEM AND METHOD THEREOF

(71) Applicant: Karriem Adams, Milpitas, CA (US)

(72) Inventor: Karriem Adams, Milpitas, CA (US)

( * ) Notice: Subject to any disclaimer, the term of this patent is extended or adjusted under 35 U.S.C. 154(b) by 0 days.

(21) Appl. No.: 16/850,430

(22) Filed: Apr. 16, 2020

Related U.S. Application Data

(60) Provisional application No. 62/870,861, filed on Jul. 5, 2019.

(51) Int. Cl.
*G07F 17/32* (2006.01)

(52) U.S. Cl.
CPC ..... *G07F 17/3211* (2013.01); *G07F 17/3223* (2013.01)

(58) Field of Classification Search
USPC ..... 463/31
See application file for complete search history.

(56) References Cited

U.S. PATENT DOCUMENTS 10,046,232 B2 * 8/2018 Aoki ..... G07F 17/322
2018/0204416 A1 * 7/2018 Perea-Ochoa ..... G07F 17/3218
2020/0043233 A1 * 2/2020 Nelson ..... G06T 19/006
2020/0058196 A1 * 2/2020 Nelson ..... G07F 17/3267
2020/0152018 A1 * 5/2020 Baerlocher ..... G07F 17/3211

* cited by examiner

*Primary Examiner* — Pierre E Elisca
(74) *Attorney, Agent, or Firm* — Gulf Coast Intellectual Property Group

(57) ABSTRACT

An augmented reality game system that facilitates the participation of remote players in casino table games. The game system and method of the present invention utilizes a plurality of augmented reality devices that are placed in table positions at casinos. A remote player will communicably couple to the augmented reality device and utilize the elements thereof to engage in the table game such as but not limited to poker. The augmented reality game system incorporates a method wherein an operator will provide a website and a software application that facilitates registration and participation of casinos and remote players. Subsequent operable coupling with an augmented reality device, a remote player will receive liver video feed, audio data and scanned poker card data images from the augmented reality device. The remote player has operational control of the augmented reality device and utilizes to communicate with a dealer at the table game.

20 Claims, 4 Drawing Sheets

AUGMENTED REALITY GAME SYSTEM AND METHOD THEREOF

PRIORITY UNDER 35 U.S.C Section 119(e) & 37 C.F.R. Section 1.78

This nonprovisional application claims priority based upon the following prior U.S. Provisional Patent Application entitled: Augmented Reality Game System, Application No. 62/870,861 filed Jul. 5, 2019, in the name of Karriem Adams, which is hereby incorporated by reference for all purposes.

FIELD OF THE INVENTION

The present invention relates generally to gaming systems, more specifically but not by way of limitation, an augmented reality based gaming system that facilitates the ability for remote players to participate in games at a facility such as but not limited to a casino wherein the present invention provides an interactive experience similar to that of being physically present in the facility.

BACKGROUND

In the United States the gambling industry is a multi-billion dollar per year industry. While some states have more open regulations than others, most states have at least some form of entertainment wherein it is permissible to bet with the provider or other individuals participating in the activity. Gambling activities include betting on events such as but not limited to horse racing. The most popular form of gambling are casinos wherein casinos provide numerous types of table games ranging from roulette to card games and many others. Casinos are destinations and are not provided in all states. Most states allow some form of online gaming wherein a player can login to a website and play a game such as but not limited to poker and place bets. One of the problems with this is the lack of simulation of reality. Online poker games are software simulations of card games the use algorithms and a software interface to simulate a poker game. These can be financially risky and further do not provide a true poker game experience.

The online gaming industry includes the ability to virtually place bets on games and events but does not provide simulation and an interaction synonymous with attending a facility such as but not limited to a casino. Many players desire the interaction with the dealer and the other players as part of the tactile experience of participating in a game. Additionally, similar to the appeal of attending a destination like Las Vegas, players enjoy the opportunity to visit various casino facilities to participate in a variety of games.

Accordingly, there is a need for an online augmented reality game system that is configured to provide a remote player an augmented reality experience at a facility such as but not limited to a casino wherein the present invention facilitates the ability for the remote player to join a game being played at a table in the casino.

SUMMARY OF THE INVENTION

It is the object of the present invention to provide an augmented reality gaming system that facilitates the ability for a remote player to join a table game at a casino wherein the present invention includes a software application configured to facilitate the execution of the present invention.

Another object of the present invention is to provide an augmented reality gaming system operable to facilitate a casino or similar facility to receive a remote player at a table game or the like wherein the system of the present invention includes an augmented reality device placed at a table and engaged by the remote player.

A further object of the present invention is to provide an augmented reality gaming system that facilitates the ability for a remote player to join a table game at a casino wherein the software of the present invention facilitates establishment of a player account for a remote player.

Still another object of the present invention is to provide an augmented reality gaming system operable to facilitate a casino or similar facility to receive a remote player at a table game or the like wherein the system of the present invention further includes monetary deposits at each participating casino.

An additional object of the present invention is to provide an augmented reality gaming system that facilitates the ability for a remote player to join a table game at a casino wherein a remote player utilizes the software application to operably couple to an augmented reality device in a player position on a game table.

Yet a further object of the present invention is to provide an augmented reality gaming system operable to facilitate a casino or similar facility to receive a remote player at a table game or the like wherein the system of the present invention utilizes the augmented reality device to receive dealt cards and wherein the remote player has visible access thereto.

Another object of the present invention is to provide an augmented reality gaming system that facilitates the ability for a remote player to join a table game at a casino wherein the system of the present invention further leverages staff at the casinos to provide some operational parameters of the present invention.

Still an additional object of the present invention is to provide an augmented reality gaming system operable to facilitate a casino or similar facility to receive a remote player at a table game or the like wherein the present invention utilizes poker chips provided by the casino for the remote player.

An alternative object of the present invention is to provide an augmented reality gaming system that facilitates the ability for a remote player to join a table game at a casino wherein the present invention provides a live video feed and scanned data image to the remote player.

An additional object of the present invention is to provide an augmented reality gaming system operable to facilitate a casino or similar facility to receive a remote player at a table game or the like wherein the present invention further utilizes safes or similar item at a casino to avoid online transfer of funds.

Another object of the present invention is to provide an augmented reality gaming system that facilitates the ability for a remote player to join a table game at a casino wherein the present invention further includes game centers at remote locations such as but not limited to restaurants wherein the game center facilitates the ability for a player to join a table game at another facility.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
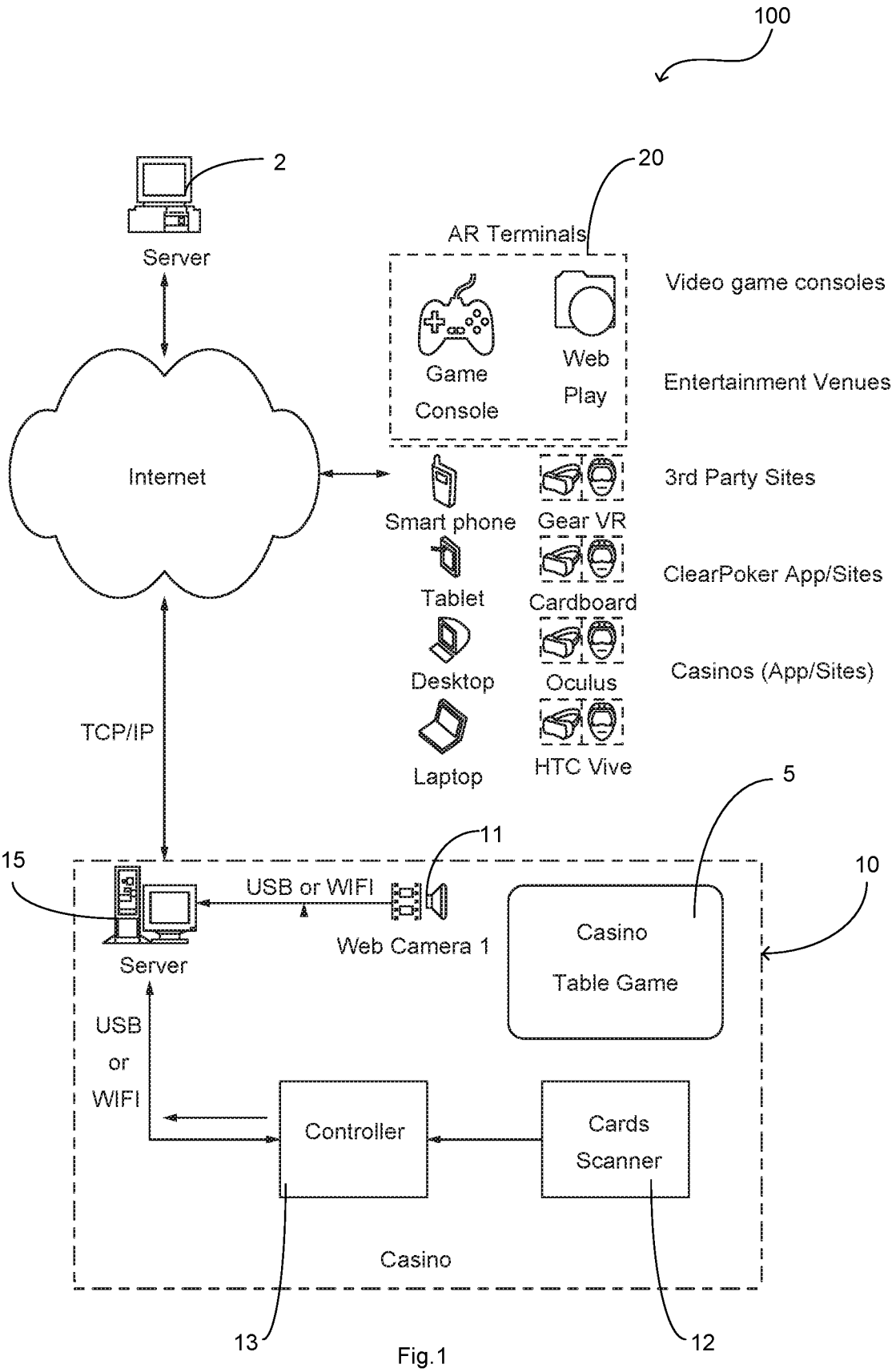
FIG. 1 is a schematic of the architecture of the present invention.

Referring now to the drawings submitted herewith, wherein various elements depicted therein are not necessarily drawn to scale and wherein through the views and figures like elements are referenced with identical reference numerals, there is illustrated an augmented reality game system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the augmented reality game system 100 is illustrated in a schematic architecture. The augmented reality game system 100 facilitates the ability for a remote player to participate in a table game such as but not limited to poker, wherein the remote player operably couples to an augmented reality device 10 that is placed in a player position on a casino table game 5. The augmented reality device 10 includes a camera 11, a card scanner 12, and a controller 13 wherein the aforementioned provide the ability to engage in a poker game. The augmented reality device 10 is operably coupled to a server 15 that includes the necessary electronics to be communicably coupled to the Internet utilizing conventional communication protocols. The controller 13 includes the necessary electronics to receive, store, transmit and manipulate data and facilitates operation of the augmented reality device 10. A remote player communicably couples to the augmented reality device 10 and can visually and audibly engage a dealer and other players located at the casino table game 5. The card scanner 12 facilitates scanning the image of the card ensuing placement of a card by a dealer wherein the scanned image data is transferred to the remote player. It should be understood within the scope of the present invention that the card scanner 12 could employ alternate technologies that include but are not limited to object recognition and object tracking wherein the card scanner employs visual data capture recognition so as to ascertain values of items such as but not limited to cards or dice. A camera 11 provides video data to the remote player wherein the position of the camera 11 can be manipulated by the remote player.

It is contemplated within the scope of the present invention that remote players can engage with the augmented reality game system 100 utilizing various augmented reality terminals 20 wherein these augmented reality terminals 20 can be located in various facilities and be alternate types of computing devices. By way of example but not limitation, the augmented reality terminals 20 can be video game consoles, smart phones, tablet PC's and desktop PC's. These augmented reality terminals 20 have loaded thereon the necessary software to facilitate participation in the augmented reality game system 100 for a remote player. The augmented reality terminals 20 are communicably coupled to a server 2 wherein the server 2 is a conventional computer server having the necessary electronics to facilitate operation of the augmented reality game system 100. It should be understood within the scope of the present invention that various quantities and types of computer servers could be utilized to provide operation of the augmented reality game system 100.

Figure 2:
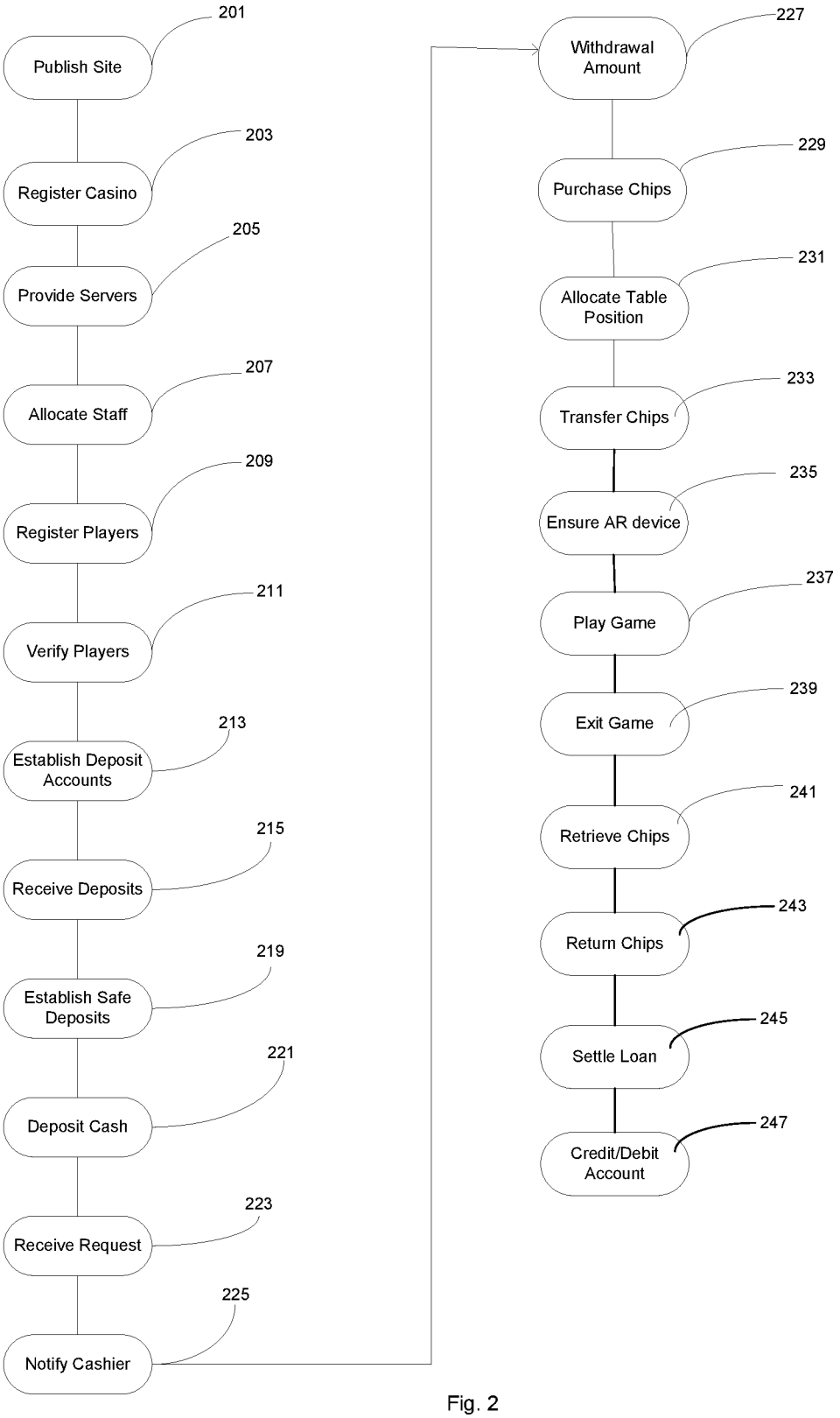
FIG. 2 is a flowchart of the process for the operator in the present invention.

Now referring in particular to FIG. 2 submitted as a part hereof, the process flow for the operator of the augmented reality game system 100 is diagrammed therein. In step 201, the operator of the augmented reality game system 100 will utilize server 2 and publish a website providing an interface for players and casinos to access and engage the augmented reality game system 100. Step 203, casino facilities will utilize the website to register with the augmented reality game system 100. The augmented reality game system 100 is configured to communicably couple with a multitude of casinos and similar gaming facilities so as to provide remote players access to table games located at these facilities. Step 205, if required the operator will deploy the necessary server hardware at the casino facilities that have registered with the augmented reality game system 100. In step 207, the augmented reality game system 100 will include staffing that are responsible for providing certain activities described herein so as to facilitate execution of the augmented reality game system 100. As such, the operator of the augmented reality game system 100 will hire and train the required staff. Step 209, through promotion and other techniques the operator of the augmented reality game system 100 will attract and register remote players. It should be understood within the scope of the present invention that the during the registration process, the operator will execute steps such as but not limited to demographic collection and account setup. In step 211, the operator will verify the registered players age and location utilizing suitable techniques and resources so as to ensure compliance with any laws and/or regulations governing gambling activities.

In step 213, the players will establish deposit accounts. Deposit accounts are financial accounts held with the operator wherein the deposit accounts are utilized to receive funds for participation in table games at the casinos. The deposit accounts are configured to receive funds in alternate manners such as but not limited to credit cards or wire transfers. Step 215, the operator receives deposits from registered players in order to establish a balance in the deposit account for use in playing table games at the casinos. In step 219, the operator will establish safe deposits at the casinos enrolled in the augmented reality game system 100. The safe deposits are suitable secure devices for receiving and storing currency. Step 221, the operator of the augmented reality game system 100 deposits currency into the safe deposits located at each of the casinos registered with the augmented reality game system 100. It should be understood within the scope of the present invention that the amount of currency could vary but is sufficient to support a plurality of remote players and their engagement with the casino.

In step 223, the operator of the augmented reality game system 100 will receive a request from a remote player to virtually participate in a table game at one of the registered casinos. It is contemplated within the scope of the present invention that the augmented reality game system 100 could provide a list or visual representation of the available registered casinos. Furthermore, the augmented reality game system 100 can be configured to present the various types of available poker games available to a user and allow a user to choose therefrom. The request will identify the casino, which game the remote player would like to participate in and further provide the amount of money the remote player would like utilize to initiate participation in a table game. The request is an electronic submission through the software application of the present invention. In step 225, the operator provides notification to a staffed personnel located at the casino that a remote player desires to participate in a table game at that casino facility. Step 227, subsequent receiving notification of the remote player request and the amount of currency requested, the personnel at the casino will remove the requested currency amount from the safe deposit. In step 229, the personnel utilizes the currency removed from the safe deposit to purchase poker chips from the casino facility wherein the value of the poker chips has a value equal to that of the amount of currency removed from the safe deposit.

In step 231, the casino will allocate a table position to the remote player and provide notification to the personnel of the augmented reality game system 100. Step 233, the personnel of the augmented reality game system 100 will transport the poker chips and an augmented reality device 10 to the allocated table position. In step 235, the personnel of the augmented reality game system 100 will ensure proper operation of the augmented reality device 10 and the remote players active connection therewith. Step 237, the remote player will participate in at least one table game in accordance with the rules thereof. In step 239, upon completion of engagement with the table game, the remote player will notify the operator of the augmented reality game system 100 of their desire to exit the game wherein the notification is transmitted through the software application of the augmented reality game system 100. Step 241, the personnel of the augmented reality game system 100 will proceed to the allocated table position having the augmented reality device 10 and poker chips of the remote player and retrieve any remaining poker chips belonging to the player and the augmented reality device 10. It should be understood within the scope of the present invention that the remote player could participate in the table game until depletion of the poker chips and either transmit a notification to exit the game or transmit a notification for additional poker chips to be transferred to the allocated table position. In step 243, the personnel of the augmented reality game system 100 exchanges any remaining poker chips of the remote player with the casino for a currency value equivalent thereto. In step 245, the player will reconcile the amount removed from the safe deposit returning an amount of currency equivalent to the amount removed. Step 247, the player's deposit account is either debited or credited depending on the requirement for reconciliation of the safe deposit.

Figure 3:
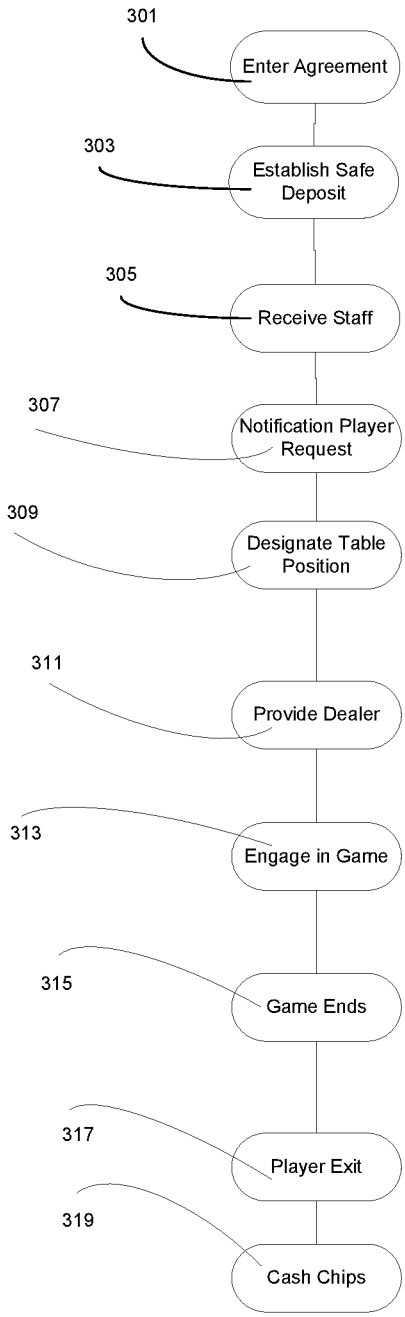
FIG. 3 is a flowchart of the process of the casino in the present invention.

Now referring in particular to FIG. 3, the process flow for a casino registered with the augmented reality game system 100 is diagrammed therein. In step 301, the casino will enter into an agreement with the operator of the augmented reality game system 100 and register therewith. It should be understood within the scope of the present invention that the casinos and operator of the augmented reality game system 100 will have an agreement outlining various business terms and conditions. In step 303, the casino will provide a location for the safe deposits previously discussed herein. Step 305, the casino provides any required badging, facility training or other requirements for the personnel of the operator of the augmented reality game system 100 that perform the activities previously described herein. It should be understood within the scope of the present invention that the operator of the augmented reality game system 100 and the casino as part of their agreement utilize casino employees to perform the tasks previously described herein requiring personnel interaction.

In step 307, the casino will receive a notification that a remote player desires to participate in a table game at the casino. Step 309, the casino will designate a position at a table wherein the game being played at the table is the game desired by the remote player. In step 311, the casino will provide a dealer at the table if not already present. Step 312, the casino will exchange a provided currency amount for poker chips to be utilized in participating in the table game. Step 313, the dealer will engage in the table game with the remote player and any other players present at the table. Step 315, the remote player notifies request to end participation in the table game. In step 317, the casino receives request for a remote player to exit the table game. Step 319, the casino will redeem the poker chips for the currency amount equivalent thereto.

Figure 4:
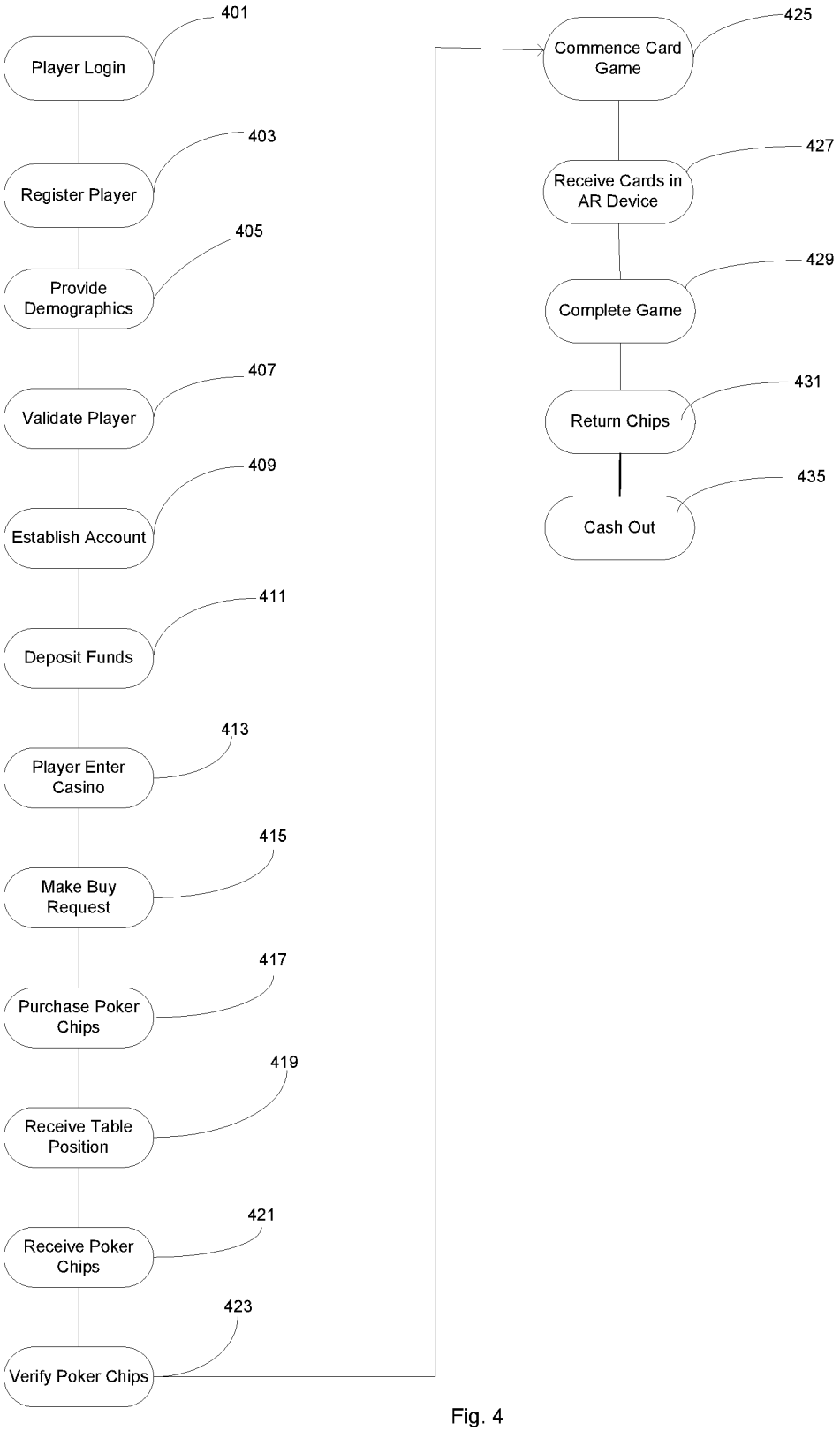
FIG. 4 is a flowchart of the process of the player in the present invention.

Referring now to FIG. 4, the process flow for a remote player participating in the augmented reality game system 100 is diagrammed therein. In step 401, a remote player will download the software application of the present invention or visit the website of the augmented reality game system 100. Step 403, utilizing the software application of the present invention the remote player will commence the registration process required to participate in the augmented reality game system 100. In step 405, during the registration process, the remote player will provide certain demographic information such as but not limited to age and geographic location. Step 407, the remote player will provide verification documents such as but not limited to a copy of a government issued identification so as to validate age. In step 409, the remote player will establish a deposit account wherein the remote player will access the deposit account as needed to either deposit or withdraw funds therefrom. The remote player will be graphically presented on the user interface the amount in their deposit account as well as any requested withdrawals therefrom. Step 411, subsequent establishment of a deposit account, the remote player will provide an initial deposit thereinto. It should be understood within the scope of the present invention that the remote player will make alternate deposits as required to continue participating in the augmented reality game system 100.

In step 413, the remote player decides to participate in a table game at one of the casinos registered with the augmented reality game system 100. Step 415, the remote player will initiate a buy request through the software application for an amount of currency the remote player desires to utilize for participating in a table game. In step 417, the operator of the augmented reality game system 100 will facilitate the exchange of currency from the buy request for poker chips at the casino. Step 419, the player will receive notification through the software application of the present invention of the table and table position that has been allocated to the remote player. Additionally, an augmented reality device 10 will be placed in the allocated table position and the remote player will operably engage therewith as previously described herein. Step 421, the remote player will have their purchased poker chips transferred to the allocated table and position. In step 423, the remote player will verify the amount of the poker chips utilizing the augmented reality device 10 wherein the camera 11 can be moved by the remote player in order to visually inspect the poker chips and the amount thereof. Step 425, the remote player will begin participating in the table game. In step 427, the remote player receives the poker cards on the card scanner 12 of the augmented reality device 10 and the scanned image of the poker cards is transferred to the remote player. Step 429, the remote player will complete participation in at least one game and ensuing completion of the desired quantity of table games, the remote player will transmit a signal utilizing the software application of the present invention to the operator of the augmented reality game system 100 of their desire to terminate participation in the table game. Step 431, the remote player will transmit instructions to personnel of the augmented reality game system 100 to return any remaining poker chips to the casino and redeem for the currency value thereof. In step 435, the remote player will have any applicable fund value reconcile with the safe deposit amount and the remote players deposit account. It should be understood that the operator of the augmented reality game system 100 provides a temporary loan of the requested amount from the safe deposit at the casino and that amount is either returned at the end of the game via a deposit or transfer from the deposit account of the remote player.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method of facilitating participation of at least one remote player in a casino game comprising the steps of:

installing at least one server, wherein the at least one server includes electronics configured to receive, store, transmit and manipulate data, said at least one server being communicably coupled to a computer network;

providing a software application, wherein the software application is stored on the at least one server;

registering at least one casino, wherein the at least one casino is registered with an operator of the method;

registering at least one remote player, wherein the at least one remote player is registered with the operator;

providing an augmented reality device, wherein the augmented reality device is within the at least one casino and wherein the augmented reality device is proximate a casino game, said augmented reality device being communicably coupled to the at least one server;

accessing the augmented reality device, wherein the at least one remote player accesses the augmented reality device utilizing the computer network; and utilizing the augmented reality device to participate in a casino game taking place proximate the augmented reality device.

2. The method of facilitating participation of at least one remote player in a casino game as recited in claim 1, and further the step of establishing safe deposits at the at least one casino, wherein the safe deposits are operable to store currency for use by the at least one player.

3. The method of facilitating participation of at least one remote player in a casino game as recited in claim 2, and further including the step of receiving a casino game piece with the augmented reality device, wherein the augmented reality device transfers an image of the casino game piece to the at least one remote player.

4. The method of facilitating participation of at least one remote player in a casino game as recited in claim 3, and further including the step of transferring live video data to the at least one remote player, wherein the augmented reality device includes a camera configured to capture video of an area proximate the augmented reality device.

5. The method of facilitating participation of at least one remote player in a casino game as recited in claim 4, and further including the step of communicating with at least one individual participating in the casino game, wherein the at least one remote player utilizes the augmented reality device to audibly communicate with the at least one individual.

6. The method of facilitating participation of at least one remote player in a casino game as recited in claim 5, and further including the step of manipulating the augmented reality device, wherein the at least one remote player moves the camera on the augmented reality device so as to alter a view of the casino game.

7. The method of facilitating participation of at least one remote player in a casino game as recited in claim 6, and further including the step of loaning an amount of currency from the safe deposit to the at least one remote player for use in playing the casino game.

8. An augmented reality casino game playing method comprising the steps of:

installing a plurality of servers, wherein the plurality of servers include electronics configured to receive, store, transmit and manipulate data, said plurality of servers being communicably coupled to a computer network;

providing a software application, wherein the software application is stored on one of the plurality of servers;

registering a plurality of casinos, wherein the plurality of casinos are registered with an operator of the augmented reality casino game;

entering into an agreement, wherein the plurality of casinos enter into an agreement with the operator of the augmented reality casino game;

establishing at least one safe deposit at each of the plurality of casinos, wherein the safe deposits are configured to receive and store currency;

registering a plurality of remote players, wherein the plurality of remote players are registered with the operator;

identifying a casino, wherein one of the plurality of remote players identifies a registered casino in which the one of the remote players desires to participate in a game therein;

requesting to participate in a game, wherein one of the plurality of remote players transmits a request to the operator of the augmented reality casino game to participate in a game at one of the plurality of casinos;

placing an augmented reality device on a gaming table in one of the plurality of casinos;

connecting to the augmented reality device, wherein a remote player communicably couples to the augmented reality device; and participating in the game, wherein the remote player utilizes the augmented reality device to participate in the game at the gaming table.

9. The augmented reality casino game playing method as recited in claim 8, and further including the step of creating a deposit account, wherein each of the plurality of remote players create a deposit account operable to receive funds for use in participation of the augmented reality casino game.

10. The augmented reality casino game playing method as recited in claim 9, and further including the step of loaning a remote player funds, wherein the operator of the augmented reality casino game provides funds from the safe deposit to a remote player.

11. The augmented reality casino game playing method as recited in claim 10, and further including the step of placing the augmented reality device on a casino game table, wherein an operator personnel superposes the augmented reality device on the casino game table in a player position.

12. The augmented reality casino game playing method as recited in claim 11, and further including the step of receiving at least one casino game piece with the augmented reality device.

13. The augmented reality casino game playing method as recited in claim 12, and further including the step of transferring a data image of the at least one casino game piece to the remote player communicably coupled with the augmented reality device.

14. The augmented reality casino game playing method as recited in claim 13, and further including the step of placing poker chips at the casino game table wherein the poker chips were purchased from the casino with funds removed from the safe deposit.

15. An augmented reality casino game playing method that facilitates players in locations other than a casino to participate in a card game at the casino comprising the steps of:

installing a plurality of servers, wherein the plurality of servers include electronics configured to receive, store, transmit and manipulate data, said plurality of servers being communicably coupled to a computer network;

providing a software application, wherein the software application is stored on one of the plurality of servers;

registering a plurality of casinos, wherein the plurality of casinos are registered with an operator of the augmented reality casino game;

entering into an agreement, wherein the plurality of casinos enter into an agreement with the operator of the augmented reality casino game;

staffing at least one individual at each of the plurality of casinos, wherein the at least one individual is responsible for performing tasks on behalf of a plurality of remote players;

establishing at least one safe deposit at each of the plurality of casinos, wherein the safe deposits are configured to receive and store currency;

registering a plurality of remote players, wherein the plurality of remote players are registered with the operator;

validating each of the plurality of remote players, wherein the operator of the augmented reality casino game validates an age for the plurality of remote players;

creating a deposit account, wherein each of the plurality of remote players create a deposit account, said deposit account operable to receive funds from a remote player for use in participating in a card game;

identifying a casino, wherein one of the plurality of remote players identifies a registered casino in which the one of the remote players desires to participate in a game therein;

requesting to participate in a game, wherein one of the plurality of remote players transmits a request to the operator of the augmented reality casino game to participate in a game at one of the plurality of casinos;

loaning a remote player funds from the safe deposit, wherein the at least one individual will withdraw funds from the safe deposit and purchase poker chips therewith;

placing an augmented reality device on a gaming table in one of the plurality of casinos, wherein the augmented reality device includes audio visual equipment;

connecting to the augmented reality device, wherein a remote player communicably couples to the augmented reality device;

participating in the game, wherein the remote player utilizes the augmented reality device to participate in the game at the gaming table;

transferring live video data, wherein the augmented reality device transfers live video data to a remote player communicably coupled thereto.

16. The augmented reality casino game playing method as recited in claim 15, and further including placing at least one playing card on the augmented reality device.

17. The augmented reality casino game playing method as recited in claim 16, and further including the step of scanning an image of the at least one playing card, wherein the augmented reality device captures an image of the at least one playing card.

18. The augmented reality casino game playing method as recited in claim 17, and further including the step of transferring the scanned image of the at least one playing card to the remote player communicably coupled therewith.

19. The augmented reality casino game playing method as recited in claim 18, and further including the step of placing remote terminals in alternate commercial locations, wherein the operator of the augmented reality device places remote terminals in locations other than the plurality of casinos for use by remote players.

20. The augmented reality casino game playing method as recited in claim 19, and further including the step of manipulating a camera, wherein the camera is incorporated into the augmented reality device, said camera being controlled by the remote player communicably coupled with the augmented reality device.

* * * * *